US006032471A

United States Patent [19]

Choi

[11] Patent Number: 6,032,471

[45] Date of Patent: Mar. 7, 2000

[54] DEFROST CONTROL METHOD FOR USE IN A REFRIGERATOR

[75] Inventor: Byung Joon Choi, Seoul, Rep. of Korea

[73] Assignee: Daewoo Electronics Co., Ltd., Seoul, Rep. of Korea

[21] Appl. No.: 09/217,606

[22] Filed: Dec. 22, 1998

[30] Foreign Application Priority Data

Oct. 31, 1998 [KR] Rep. of Korea ..... 98-46679
Oct. 31, 1998 [KR] Rep. of Korea ..... 98-46680

[51] Int. Cl.[7] ..... F25B 47/02

[52] U.S. Cl. ..... 62/153; 62/155; 62/156; 62/180

[58] Field of Search ..... 62/151, 153, 155, 62/156, 80, 180, 275, 276, 82, 282

[56] References Cited

U.S. PATENT DOCUMENTS 5,564,286 10/1996 Suse ..... 62/153
5,673,565 10/1997 Jeong et al. ..... 62/156 X
5,887,443 3/1999 Lee et al. ..... 62/155 X
5,924,298 7/1999 Yoo ..... 62/153

*Primary Examiner*—Harry B. Tanner
*Attorney, Agent, or Firm*—Pennie & Edmonds LLP

[57] ABSTRACT

The invention provides a method of defrosting a frost load accumulated on an evaporator, the method comprising the steps of: performing a normal mode for controlling ON-OFF operations of the compressor; sensing a temperature of the evaporator, comparing the sensed temperature with a first preset temperature to thereby determine a significant amount of frost; if the sensed temperature is less than the first preset temperature, removing the frost by activating the fan and the heater for a predetermined duration; determining whether or not the fan should be activated during the defrost mode, by sensing and comparing temperatures outside/inside the refrigerator, and a total number of instances of a refrigerator door opening and closing; checking whether or not the duration has elapsed, and if the duration has not elapsed, continuously activating the heater; and de-activating the heater if the duration has elapsed and performing the normal mode.

10 Claims, 3 Drawing Sheets

DEFROST CONTROL METHOD FOR USE IN A REFRIGERATOR

FIELD OF THE INVENTION

The present invention relates to a refrigerator; and, more particularly, to a method for defrosting frost formed on an evaporator while keeping the temperature inside the refrigerator constant.

DESCRIPTION OF THE PRIOR ART

In a conventional refrigerator including a refrigerator and a freezor compartments, refrigerating and freezing functions are mainly performed with the help of an evaporator disposed at back of the freezer compartment, and an evaporator fan positioned on top of the evaporator.

Such an evaporator normally includes a multiplicity of fins for providing a large surface area for a heat exchange reaction between the coolant circulating inside the evaporator and outside environment, the coolant being used for cooling the air to be circulated inside the refrigerator.

The refrigeration in the refrigerator compartment is performed in an iterative cycle, wherein the cold air from the evaporator is introduced into the refrigerator compartment through one passage to be circulated therein; and the circulated air is then fed back to the evaporator through another passage to be cooled again, the temperature of which increasing while being circulated inside the refrigerator compartment by being mixed with the air inside the refrigerator. Under this situation, as is well known, as a result of a difference between the temperature inside the refrigerator compartment and that of the evaporator, frost useually gets formed around the fins of the evaporator during the heat exchange between the fins and the outside environment, the frost degrading the refrigerating efficiency of the refrigerator.

To cope with this situation, a heater is generally installed at bottom of the evaporator to melt the frost. This heater is known as the "defrost heater".

In the conventional refrigerator with such a defrost heater, when the operating mode thereof is sqitched from a normal mode to a defrost mode, the heater and the evaporator fan become simultaneously activated and deactivated, wherein the normal mode refers to a state at which a control unit in the refrigerator controls the activation and de-activation of a compressor to allow the temperature inside the compartments to be maintained at a predetermined temperature, and the defrost mode refers to a state at which the defrost heater is activated to melt the frost, the activation of the heater depending on a temperature sensed by a defrost sensor disposed on top of the evaporator.

However, the conventional refrigerator suffers from the disadvantage that since during the defrost mode the activation of the heater is followed by the de-activation of the fan without any consideration given to the temperature within the refrigerator compartment, the temperature within the refrigerator compartment gradually increases, which may, in turn, lead to a degradation in the quality of foods stored therein, i.e., its ability to maintain the freshness of the foods.

SUMMARY OF THE INVENTION

It is, therefore, a primary object of the invention to provide a method for defrosting frost formed on an evaporator of a refrigerator while keeping the temperature inside the refrigerator constant.

In accordance with the present invention, there is provided a method, for use in a refrigerator having a fan, a heater, an evaporator and a compressor, for defrosting frost accumulated on the evaporator, the method comprising the steps:

(a) performing a normal mode, wherein the normal mode represents that a control for ON-OFF operations of the compressor is performed to allow the temperature within a refrigerator compartment to be maintained at a preset temperature range;

(b) sensing a temperature of the evaporator using a defrost sensor, comparing the sensed temperature with a first preset temperature to thereby determine whether or not a significant amount of frost has been accumulated on the evaporator;

(c) in case the sensed temperature is less than the first preset temperature, operating the refrigerator in a defrost mode by activating the fan and the heater for a predetermined duration, wherein the defrost mode represents a procedure for removing the frost deposited on the evaporator;

(d) determining whether or nor the fan should be activated during the defrost mode, by sensing and comparing a temperature outside the refrigerator, a temperature inside the refrigerator and a total number of instances of a refrigerator door opening and closing;

(e) checking whether or not the predetermined duration has elapsed, and if the duration has not elapsed, continuously activating the heater; and (f) de-activating the heater if the duration has elapsed, and returning to step(a).

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENT

This invention will be described in further detail by way of example with reference to the accompanying drawings.

Figure 1:
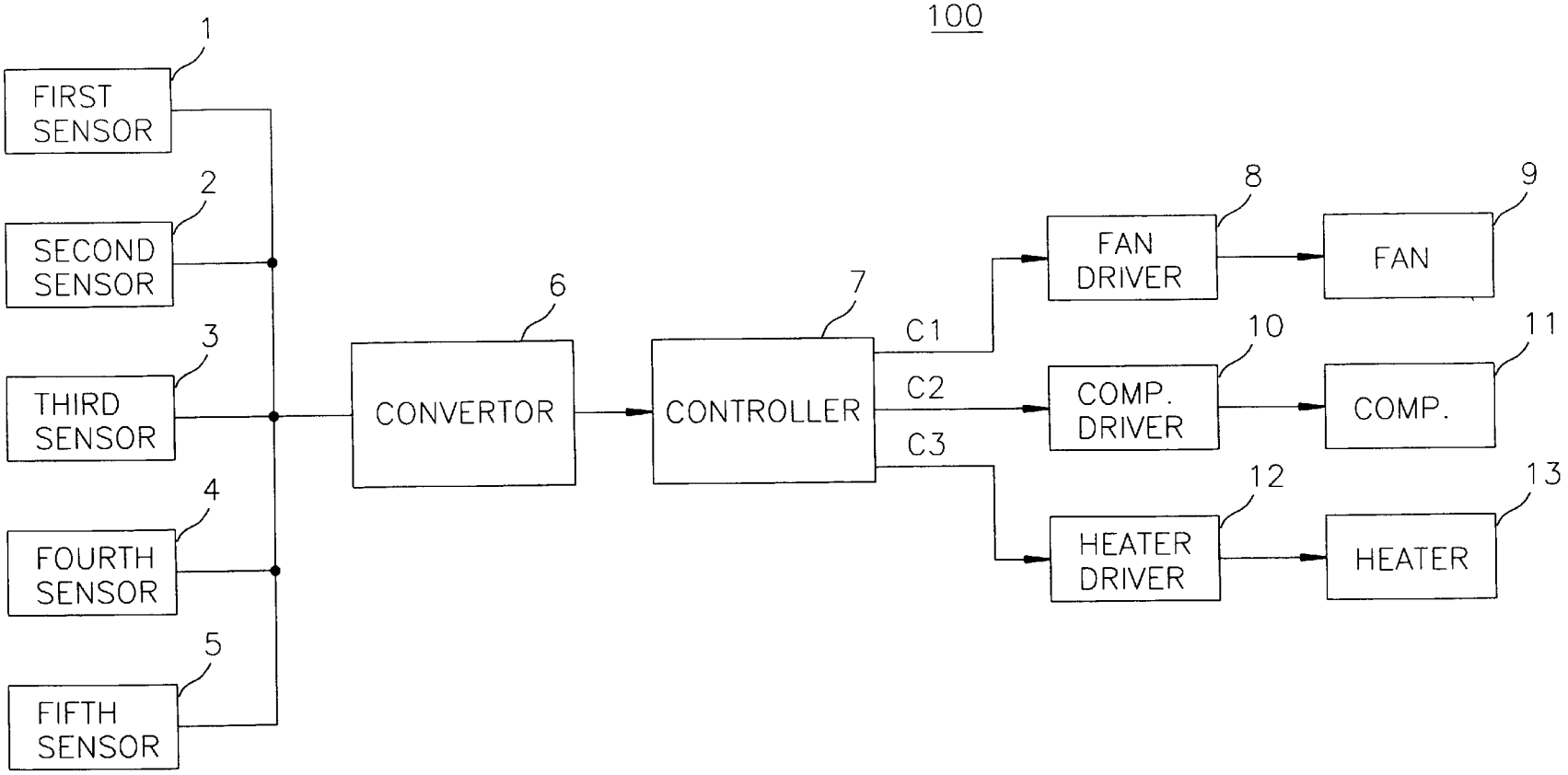
FIG. 1 presents a schematic block diagram to illustrate a refrigerator defrost system in accordance with the present invention.

There is shown in FIG. 1 a schematic block diagram illustrating a refrigerator defrost system for use in a refrigerator including a refrigerator and a freezer compartments in accordance with the present invention.

The inventive system 100 comprises a plurality of sensors 1 to 5, a converter 6, a controller 7, three drivers 8, 10 and 12 for driving a fan 9, a heater 13 and a compressor Comp. 11, respectively.

The first sensor 1 mounted outside the refrigerator, e.g., on the outer surface of the door, serves to sense an external temperature ET to output same to the converter 6.

The second sensor 2 mounted inside the refrigerator compartment serves to sense a temperature RT therein to output same to the converter 6.

The third sensor 3 disposed on top of an evaporator of the refrigerator serves to sense a temperature of the evaporator DT to allow the refrigerator to operate in a defrost mode described earlier. The third sensor 3 is referred to as "defrost sensor 3" hereinafter.

The fourth sensor 4 mounted within the freezer compartment serves to sense a temperature FT therein to output same to the converter 6.

The fifth sensor 5 mounted e.g., between a refrigerator body and one edge of the door, e.g., the refrigerator compartment door, serves to detect the accumulative number of instance the door has been opened and closed DN for a predetermined time to output same to the converter 6. The predetermined time is set to be e.g., 30 minutes.

The converter 6 converts the respective signals, i.e., temperatures and the accumulative number of the door opening and closing provided thereto from the sensors 1 to 5 into a digital signal, respectively, and pass them to the controller 7.

The controller 7, which is e.g., a microcomputer, generates control signals Cl, C2 and C3 to the fan driver 8, the Comp. driver 10 and the heater driver 12 coupled thereto, respectively, based on data fed thereto from the converter 6. In response to each of the control signals Cl, C2 and C3, the fan driver 8, the Comp. driver 10 and the heater driver 12 activate the fan 9, the Comp. 11 and the heater 13, respectively, to thereby allow an optimal defrosting to be implemented.

Hereinafter, with reference to FIGS. 2 and 3, the inventive method for controlling a defrost procedure will be describe in more detail.

The operation mode of the refrigerator is firstly in the normal mode at step S10.

During the normal mode, the controller 7 compares the temperature DT sensed by the defrost sensor 3 with a predetermined temperature PT1 to check whether or not a significant amount of frost has been accumulated on the evaporator.

At step S20, if DT is less than PT1 (e.g., −5° C.), the controller 7 determines that a significant amount of frost has been accumulated on the evaporator, and outputs the control signals C1 to C3 to the fan driver 8, the heater driver 12 and the compressor driver 10. If DT is greater than PT1, then control passes to step S21 in FIG. 3 via Tap A, wherein a decision is made to determine whether or not the defrost sensor 3 is properly operating. Details of the operation associated with FIG. 3 will be explained later.

At step S30, the fan driver 8 deactivates the fan 9 in response to the control signal C1, and the heater driver 12 activates the heater 13 for a predetermined duration, e.g., 50 minutes, upon receiving of the control signal C3.

In accordance with the preferred embodiment of the present invention, a decision is made at step S40 to determine whether or not to activate the fan 9 during the defrost mode, based on the temperatures RT and ET, and the accumulative number of instances the door has been opened and closed.

Specifically, if RT is greater than a predetermined temperature PT2, and both ET and ND shown on the following table are satisfied together, at step S50 the controller 7 activates the fan 9 for e.g., 5–6 minutes. For example, if ET is less than 15° C. and ND is set to 5, the fan 9 is activated, limiting an increase in temperature inside the refrigerator compartment, which may be caused by the activation of the defrost heater 13.

TABLE 1

| | Activation conditions of the Fan | | | | |
|---|---|---|---|---|---|
| ET | below 15° C. | 15–25° C. | 25–30° C. | 30–35° C. | above 35° C. |
| ND | 5 | 4 | 3 | 2 | 1 |

At step S60, after the activation of the fan 9, if RT is still equal to or greater than PT2, then control returns to step S50, wherein the fan 9 is again activated for 5–6 minutes; and the fan 9 is deactivated at step S70, if otherwise.

A decision is made at step S80 to check whether or not a prescribed time for activating the fan has elapsed, and if the checked result is NO then control returns to step S30 with continuously operating the defrost heater 13; and, if not, the control proceeds to step S90, to deactivate the defrost heater 13. Thereafter, the control process returns to step S10 to thereby allow the refrigerator to be operated in the normal mode, wherein the defrost heater 13 is deactivated, and both the fan 9 and the Comp. 11 are turned on.

Hereinbelow, a status determination process for the defrost sensor 3 is described in more detail with reference to FIG. 3.

As demonstrated above, since the optimal defrosting in the refrigerator may be substantially implemented with the help of the defrost sensor 3, there exists a need for a periodical monitoring of the status of the defrost sensor 3.

At step S22, the controller 7 of the invention, when the Comp. 11 is activated, detects the temperature FT within the freezer compartment sensed by the fourth sensor 4, and compares FT with DT to obtain a first difference ΔT1. Thereafter, the controller 7 determines whether the ΔT1 is equal to or greater than a predetermined temperature PT3, e.g., 5° C. to 10° C. At a switching point of the activation to the deactivation of the Comp. 11, the controller 7 again detects FT sensed by the fourth sensor 4, and compares FT with DT sensed by the fourth sensor 4 to obtain a second difference T2. Thereafter, the controller 7 determines whether the second difference AT2 is equal to or greater than the predetermined temperature PT3.

Figure 2:
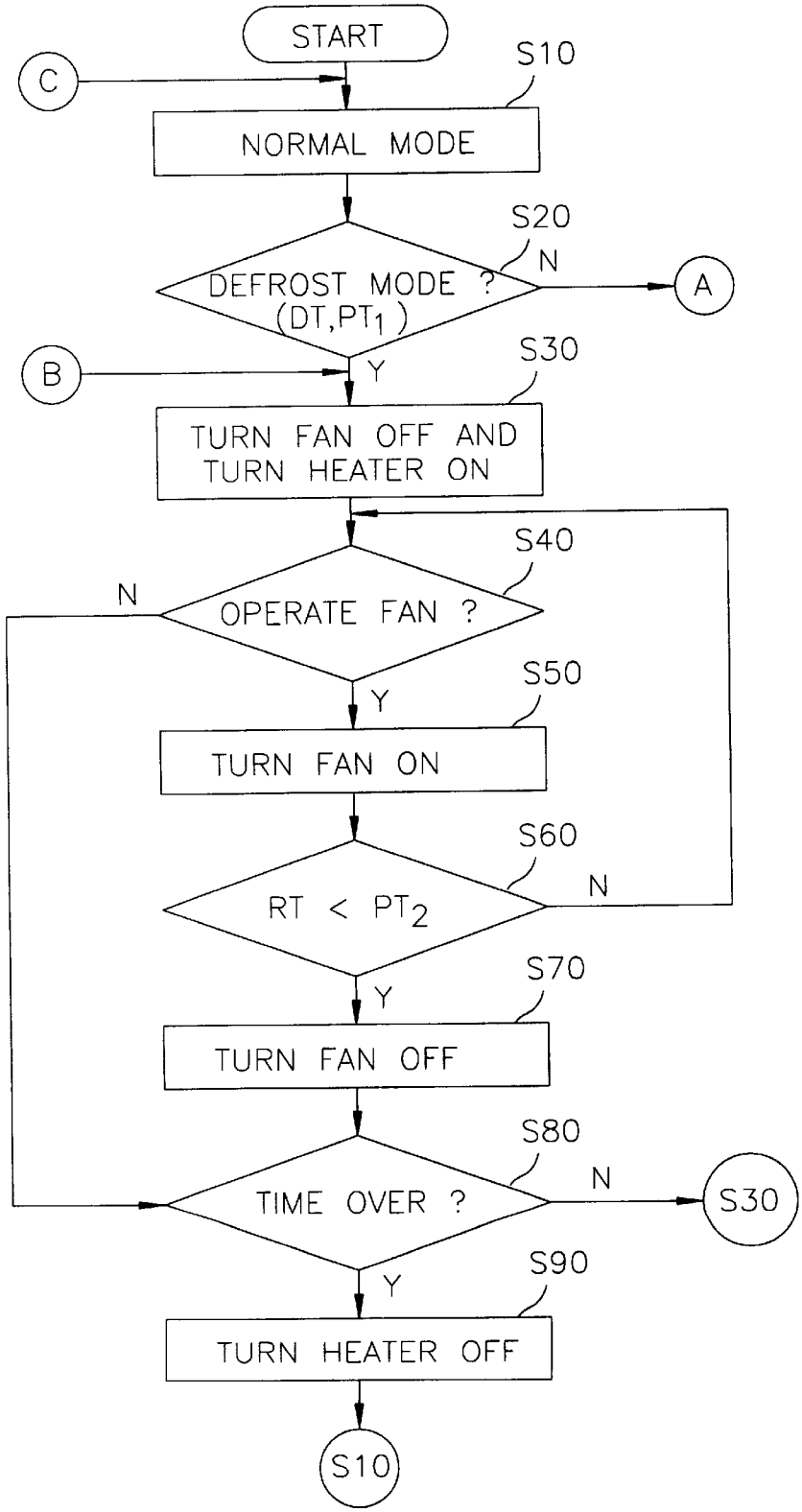
FIGS. 2 and 3 offer a flow chart which will be used to set forth a refrigerator defrost control in accordance with a preferred embodiment of the present invention.
Figure 3:
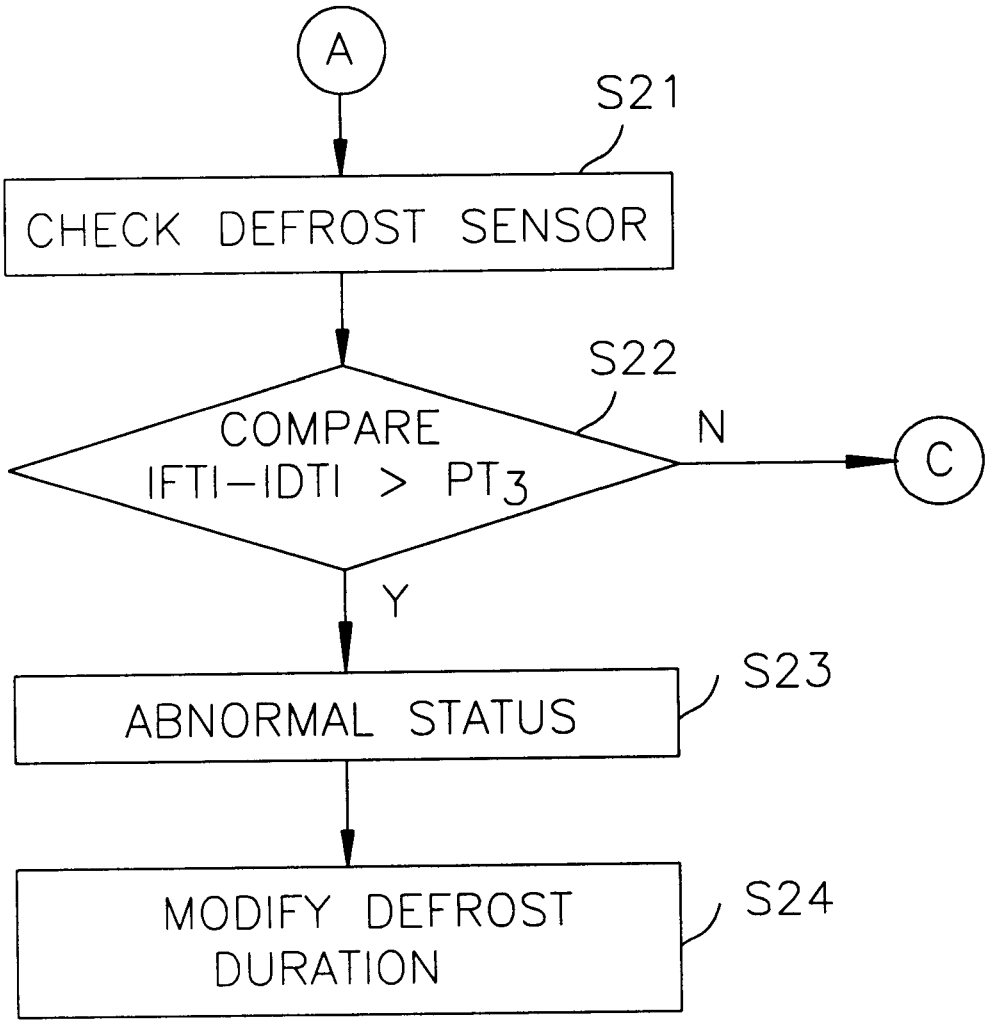

At step S22, if both of ΔT1 and ΔT2 are satisfied in relation to the predetermined temperature PT3, then the control passes to step S23, wherein the controller 7 determines that the defrost sensor 3 is in an abnormal status; and if otherwise, the control returns to step S10 in FIG. 2 via Tap C.

At step S24, the controller 7 modifies the duration of predetermined heater activation set at step S30, due to the abnormal status of the defrost sensor 3. To be more specific, if a difference between ΔT1 and ΔT2 is a sufficiently large value, e.g., 20° C., the controller 7 determines that the defrost sensor 3 is in a short status and set the duration to e.g., 40 minutes. If the difference is a suficiently small value, e.g., 12° C., the controller 7 determines that the defrost sensor 3 has undergone characteristic change and set the duration to e.g., 80 minutes.

As may be seen from the above, it should be readily appreciated that the invention enables the evaporator fan to be adaptively operated during the activation of the heater, thereby preventing the temperature inside the refrigerator compartment to change excessively.

Furthermore, the present invention periodically monitors the status of the defrost sensor during the operation of the refrigerator to modify the activation duration of the heater to thereby render it possible to implement an optimal defrost and hence prevent a likelihood of the heater overheating.

While the present invention has been described with reference to the particular embodiments, it will be apparent to those skilled in the art that various changes and modifications may be made without departing from the spirit and scope of the invention as defined in the following claims.

What is claimed is:

1. A method, for use in a refrigerator having a fan, a heater, an evaporator and a compressor, for defrosting frost accumulated on the evaporator, the method comprising the steps:

(a) performing a normal mode, wherein the normal mode represents that a control for ON-OFF operations of the compressor is performed to allow the temperature within a refrigerator compartment to be maintained at a preset temperature range;

(b) sensing a temperature of the evaporator using a defrost sensor, comparing the sensed temperature with a first preset temperature to thereby determine whether or not a significant amount of frost has been accumulated on the evaporator;

(c) in case the sensed temperature is less than the first preset temperature, operating the refrigerator in a defrost mode by activating the fan and the heater for a predetermined duration, wherein the defrost mode represents a procedure for removing the frost deposited on the evaporator;

(d) determining whether or not the fan should be activated during the defrost mode, by sensing and comparing a temperature outside the refrigerator, a temperature inside the refrigerator and a total number of instances of a refrigerator door opening and closing;

(e) checking whether or not the predetermined duration has elapsed, and if the duration has not elapsed, continuously activating the heater; and (f) de-activating the heater if the duration has elapsed, and returning to step(a).

2. The method according to claim 1, wherein said step(d) includes;

(d1) activating the fan for the predetermined duration, if the inside temperature is greater than a second preset temperature, the outside temperature is within the predefined temperature range, and the accumulative number of the door opening and closing is a predefined number;

(d2) after the duration has elapsed, performing a decision for whether or not the inside temperature is less than the second preset temperature; and (d3) de-activating the fan if the inside temperature is less than the second preset temperature, and again checking whether or not activating the fan is to be activated, if otherwise.

3. The method according to claim 2, wherein the first preset temperature and the predetermined duration are 0° C. and 50 minutes, respectively.

4. The method according to claim 2, wherein criterions for the outside temperature and the cumulative number of the door-openings are below 15° C., 15 to 25° C., 25 to 30° C., 30 to 35° C. and above 30° C., and 5, 4, 3, 2 and 1, respectively.

5. The method according to claim 1, wherein said step(b) further comprises:

(b1) monitoring status of the defrost sensor; and (b2) modifying the predetermined duration for the heater, if it is determined that the defrost sensor is in an abnormal status; and performing the normal mode if otherwise.

6. The method according to claim 5, wherein said step(b1) includes:

(b11) detecting a temperature within a freezer compartment, during the OFF-operation of the compressor, comparing the freezer temperature with the defrost sensor temperature to obtain a first difference therebetween;

(b12) detecting a temperature within the freezer compartment, during the ON-operation of the compressor, comparing the freezer temperature with the defrost sensor temperature to obtain a second difference therebetween;

(b13) checking the first and second differences are equal to or greater than a predetermined temperature;

(b14) determining that the defrost sensor is in a normal status, if both of the differences are less than the predetermined temperature, and performing the normal mode; and (b15) determining that the defrost sensor is in an abnormal status, if both of the differences are equal to or greater than the predetermined temperature, and modifying the predetermined duration for the heater.

7. The method according to claim 6, wherein the predetermined temperature has a range of 5 to 10° C.

8. The method according to claim 6, wherein said step (b15) includes:

(b151) determining that the defrost sensor is in a short status, if an offset between the first and second differences has a higher value, updating the duration as a first duration; and (b152) determining that the defrost sensor has undergone characteristic changes, if the offset has a lower value, updating the duration as a second duration.

9. The method according to claim 8, wherein the higher and lower values are 20° C. and 12° C., respectively.

10. The method according to claim 9, wherein the first and second durations are 40 and 50 minutes, respectively.

* * * * *